US010927690B2

(12) United States Patent
Lee et al.

(10) Patent No.: US 10,927,690 B2
(45) Date of Patent: Feb. 23, 2021

(54) VANE CARRIER, COMPRESSOR, AND GAS TURBINE INCLUDING THE SAME

(71) Applicant: DOOSAN HEAVY INDUSTRIES & CONSTRUCTION CO., LTD., Changwon-si (KR)

(72) Inventors: Hyunkyu Lee, Seoul (KR); Seol Baek, Yangju-si (KR)

( * ) Notice: Subject to any disclaimer, the term of this patent is extended or adjusted under 35 U.S.C. 154(b) by 319 days.

(21) Appl. No.: 16/391,060

(22) Filed: Apr. 22, 2019

(65) Prior Publication Data

US 2020/0025000 A1 Jan. 23, 2020

(30) Foreign Application Priority Data

May 11, 2018 (KR) ..... 10-2018-0054416

(51) Int. Cl.
*F01D 9/04* (2006.01)

(52) U.S. Cl.
CPC ..... *F01D 9/042* (2013.01); *F01D 9/041* (2013.01); *F05D 2240/12* (2013.01); *F05D 2260/30* (2013.01)

(58) Field of Classification Search
CPC ..... F01D 5/066; F01D 9/041; F01D 9/042; F01D 25/24; F01D 25/26; F05D 2240/12; F05D 2260/30
See application file for complete search history.

(56) References Cited

U.S. PATENT DOCUMENTS 1,873,743 A * 8/1932 Doran ..... F01D 25/26 415/136
5,537,814 A * 7/1996 Nastuk ..... F01D 5/066 60/796
5,605,438 A * 2/1997 Burdgick ..... F01D 25/145 415/182.1

(Continued)

FOREIGN PATENT DOCUMENTS

EP 3147457 B1 1/2019
KR 10-2011-0017664 A 2/2011

(Continued)

OTHER PUBLICATIONS

A Korean Office Action dated Jul. 10, 2019 in connection with Korean Patent Application No. 10-2018-0054416 which corresponds to the above-referenced U.S. application.

*Primary Examiner* — Igor Kershteyn
(74) *Attorney, Agent, or Firm* — Harvest IP Law, LLP

(57) ABSTRACT

Disclosed herein are a vane carrier that is uniformly deformed by heat and a gas turbine including the same. The vane carrier includes a pair of bodies having a plurality of vanes arranged on their inner peripheral surfaces, and forming an annular shape by coupling the bodies in a semi-annular form to each other, fastening parts protruding radially from outer peripheral surfaces of respective ends of the bodies coupled to each other so as to couple the bodies, and one or more deformation prevention members disposed on the outer peripheral surfaces of the bodies and protruding (Continued)

radially therefrom. Accordingly, it is possible to prevent damage to components due to heat deformation since the vane carrier is relatively uniformly deformed and to improve durability by adjusting the natural frequency of the vane carrier to avoid resonance.

18 Claims, 10 Drawing Sheets

(56) References Cited

U.S. PATENT DOCUMENTS

| | | | | |
|---|---|---|---|---|
| 8,021,109 | B2 * | 9/2011 | Kneeland | F01D 25/243 415/178 |
| 8,128,353 | B2 * | 3/2012 | Flanagan | F01D 25/265 415/182.1 |
| 8,920,109 | B2 | 12/2014 | Tham et al. | |
| 9,074,490 | B2 * | 7/2015 | Benkler | F01D 25/26 |
| 9,498,850 | B2 * | 11/2016 | Denis | F01D 25/243 |
| 2014/0301834 | A1 | 10/2014 | Pepperman et al. | |
| 2017/0009165 | A1 | 1/2017 | Goerz, Jr. | |

FOREIGN PATENT DOCUMENTS

| | | | |
|---|---|---|---|
| KR | 10-1482572 | B1 | 1/2015 |
| KR | 10-2017-0083836 | A | 7/2017 |

* cited by examiner

VANE CARRIER, COMPRESSOR, AND GAS TURBINE INCLUDING THE SAME

CROSS-REFERENCE TO RELATED APPLICATION(S)

This application claims priority to Korean Patent Application No. 10-2018-0054416, filed on May 11, 2018, the disclosure of which is incorporated herein by reference in its entirety.

BACKGROUND OF THE DISCLOSURE

Field of the Disclosure

Exemplary embodiments of the present disclosure relate to a vane carrier, a compressor, and a gas turbine including the same, and more particularly, to a vane carrier that is uniformly deformed by heat, a compressor, and a gas turbine including the same.

Description of the Related Art

A gas turbine is a power engine that mixes air compressed in a compressor with fuel for combustion and rotates a turbine using high-temperature gas produced by the combustion. The gas turbine is used to drive a generator, an aircraft, a ship, a train, etc.

This gas turbine typically includes a compressor, a combustor, and a turbine. The compressor sucks and compresses outside air, and then transmits it to the combustor. The air compressed in the compressor is in a high-pressure and high-temperature state. The combustor mixes the compressed air introduced from the compressor with fuel and burns a mixture thereof. The combustion gas produced by the combustion is discharged to the turbine. Turbine blades in the turbine are rotated by the combustion gas, thereby generating power. The generated power is used in various fields, such as generating electric power and actuating machines.

SUMMARY OF THE DISCLOSURE

The air sucked into the compressor is subject to an adiabatic compression process therein so that the pressure and temperature of the air increase. In addition, the combustion gas produced by burning the mixture of compressed air and fuel in the combustor is discharged to the turbine at a high temperature. The constituent components of the compressor or the turbine may be unevenly deformed or damage by heat due to such high-temperature gas.

An object of the present disclosure is to provide a vane carrier having a structure of relatively uniform thermal deformation, a compressor, and a gas turbine including the same.

Another object of the present disclosure is to provide a vane carrier having a structure capable of avoiding resonance, a compressor, and a gas turbine including the same.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with one aspect of the present disclosure, a vane carrier includes a pair of bodies having a plurality of vanes arranged on their inner peripheral surfaces, and forming an annular shape by coupling the bodies in a semi-annular form to each other, fastening parts protruding radially from outer peripheral surfaces of respective ends of the bodies coupled to each other so as to couple the bodies, and one or more deformation prevention members disposed on the outer peripheral surfaces of the bodies and protruding radially therefrom.

In the vane carrier according to the aspect of the present disclosure, the deformation prevention members may face each other and be symmetrically disposed with respect to the center of the annular body.

In the vane carrier according to the aspect of the present disclosure, the deformation prevention members may have a shape corresponding to the fastening parts.

In the vane carrier according to the aspect of the present disclosure, the deformation prevention members may protrude radially to a lower height than the fastening parts.

In the vane carrier according to the aspect of the present disclosure, the deformation prevention members may be made of the same material and mass as the fastening parts.

In the vane carrier according to the aspect of the present disclosure, each of the deformation prevention members may have a separation groove formed in an axial direction passing the center of the annular body.

In the vane carrier according to the aspect of the present disclosure, the deformation prevention members may be formed integrally with the bodies and the fastening parts.

In accordance with another aspect of the present disclosure, a compressor includes compressor disks arranged in a multistage manner, each having a plurality of compressor blades mounted thereto, a tie rod axially passing through the compressor disks and rotating the compressor disks by rotation thereof, a vane carrier for supporting multistage compressor vanes arranged alternately with the multistage blades, and a casing accommodating the compressor disks, the tie rod, and the vane carriers therein. The vane carrier includes a pair of bodies having the plurality of vanes arranged on their inner peripheral surfaces, and forming an annular shape by coupling the bodies in a semi-annular form to each other, fastening parts protruding radially from outer peripheral surfaces of respective ends of the bodies coupled to each other so as to couple the bodies, and one or more deformation prevention members disposed on the outer peripheral surfaces of the bodies and protruding radially therefrom.

In the compressor according to the aspect of the present disclosure, the deformation prevention members may face each other and be symmetrically disposed with respect to the center of the annular body.

The bodies may be vertically disposed so that the fastening parts are horizontally arranged in parallel with each other, and the deformation prevention members may vertically face each other.

In the compressor according to the aspect of the present disclosure, the deformation prevention members may have a shape corresponding to the fastening parts.

In the compressor according to the aspect of the present disclosure, each of the deformation prevention members may have a separation groove formed in an axial direction passing the center of the annular body.

In accordance with a further aspect of the present disclosure, a gas turbine includes a compressor to compress air introduced thereinto, a combustor to mix the air compressed in the compressor with fuel for combustion, and a turbine to generate power by gas combusted in the combustor. The compressor includes compressor disks arranged in a multistage manner, each having a plurality of compressor blades mounted thereto, a tie rod axially passing through the compressor disks and rotating the compressor disks by rotation thereof, a vane carrier for supporting multistage compressor vanes arranged alternately with the multistage blades, and a casing accommodating the compressor disks, the tie rod, and the vane carriers therein. The vane carrier includes a pair of bodies having the plurality of vanes arranged on their inner peripheral surfaces, and forming an annular shape by coupling the bodies in a semi-annular form to each other, fastening parts protruding radially from outer peripheral surfaces of respective ends of the bodies coupled to each other so as to couple the bodies, and one or more deformation prevention members disposed on the outer peripheral surfaces of the bodies and protruding radially therefrom.

In the gas turbine according to the aspect of the present disclosure, the deformation prevention members may face each other and be symmetrically disposed with respect to the center of the annular body.

In the gas turbine according to the aspect of the present disclosure, the bodies may be vertically disposed so that the fastening parts are horizontally arranged in parallel with each other, and the deformation prevention members may vertically face each other.

In the gas turbine according to the aspect of the present disclosure, the deformation prevention members may have a shape corresponding to the fastening parts.

In the gas turbine according to the aspect of the present disclosure, each of the deformation prevention members may have a separation groove formed in an axial direction passing the center of the annular body.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF SPECIFIC EMBODIMENTS

Figure 1:
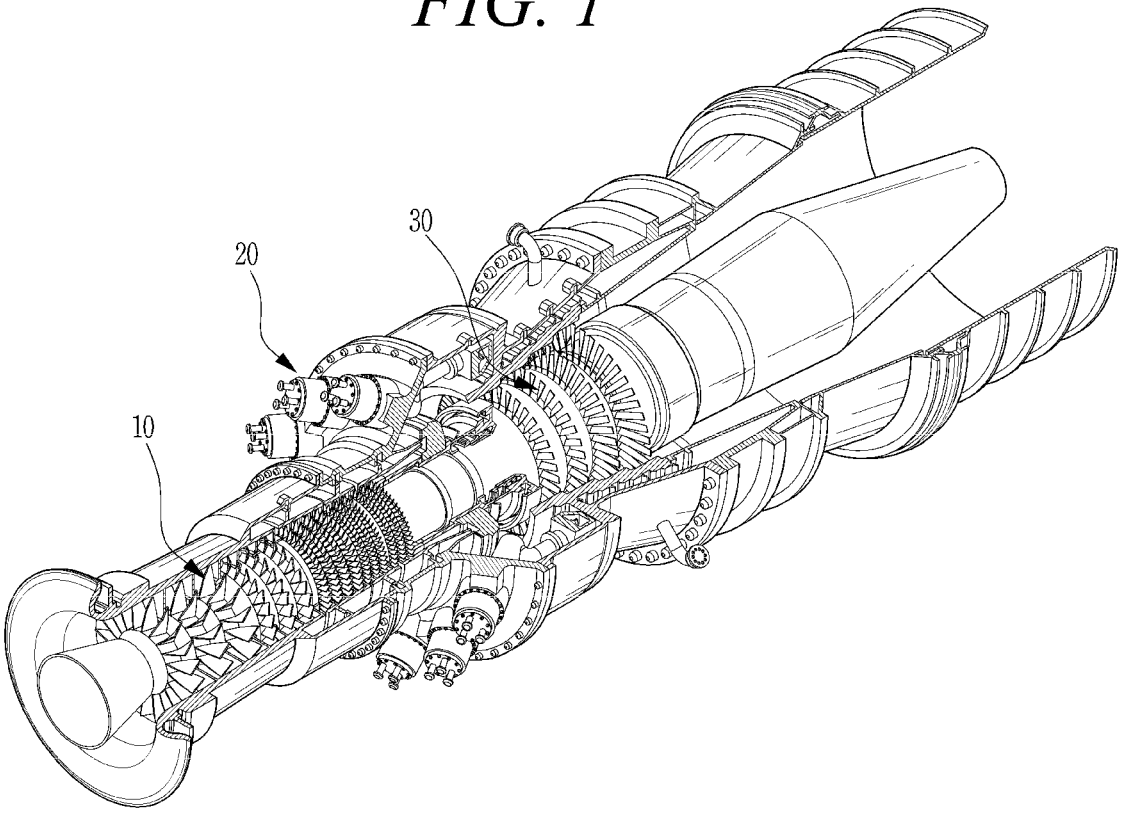
FIG. 1 is a view illustrating the interior of a gas turbine according to an embodiment of the present disclosure.

A vane carrier, a compressor, and a gas turbine including the same according to exemplary embodiments of the present disclosure will be described below in more detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

It will be understood that when a component is referred to as "comprising or including" any component, it does not exclude other components, but can further comprise or include the other components unless otherwise specified. In addition, it will be understood that a spatially-relative term "on" used herein does not necessarily mean that an element is located on another element in the direction of gravity, but it means that the element is located on or under another element.

Figure 2:
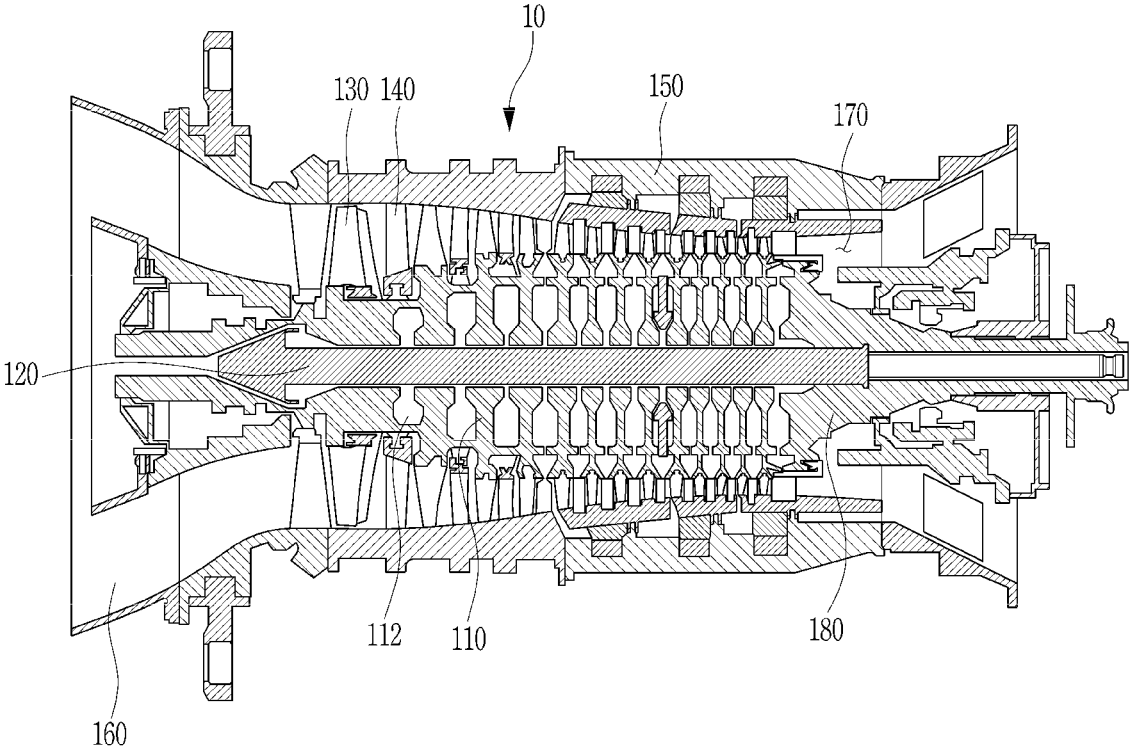
FIG. 2 is a cross-sectional view conceptually illustrating a compressor according to the embodiment of the present disclosure.

FIG. 1 is a view illustrating the interior of a gas turbine according to an embodiment of the present disclosure. FIG. 2 is a cross-sectional view conceptually illustrating a compressor according to the embodiment of the present disclosure.

Referring to FIGS. 1 and 2, the gas turbine according to the embodiment of the present disclosure includes a compressor 10 that compresses air introduced thereinto to a high pressure, a combustor 20 that mixes the compressed air supplied from the compressor 10 with fuel and burns a mixture thereof, and a turbine 30 that generates a rotational force by combustion gas produced in the combustor. In the present specification, upstream and downstream sides are defined based on the flow direction of fuel or air.

The thermodynamic cycle of the gas turbine may ideally follow a Brayton cycle. The Brayton cycle consists of four phases including isentropic compression (adiabatic compression), isobaric heat addition, isentropic expansion (adiabatic expansion), and isobaric heat dissipation. In other words, in the Brayton cycle, thermal energy, which is released by combustion of fuel in an isobaric environment after the atmospheric air is sucked and compressed to a high pressure, hot combustion gas, is expanded to be converted into kinetic energy, and exhaust gas with residual energy is then discharged to the atmosphere. The Brayton cycle consists of four processes, i.e., compression, heating, expansion, and exhaust. The present disclosure may be widely applied to a gas turbine having the same configuration as the gas turbine exemplarily illustrated in FIG. 1.

The compressor 10 of the gas turbine serves to suck and compress air, and serves to supply cooling air to a high-temperature region required for cooling in the gas turbine while supplying combustion air to the combustor 20. Since the air sucked into the compressor 10 is subject to an adiabatic compression process therein, the pressure and temperature of the air passing through the compressor 10 increase.

The compressor 10 of the gas turbine may be typically designed as a centrifugal compressor or an axial compressor. In general, the centrifugal compressor is applied to a small gas turbine, whereas a multistage axial compressor is applied to the large gas turbine as illustrated in FIG. 1 because it is necessary to compress a large amount of air.

The compressor 10 is driven using a portion of the power output from the turbine 30. To this end, the rotary shaft of the compressor 10 is directly connected to the rotary shaft of the turbine 30, as illustrated in FIG. 1.

The compressor 10 includes a compressor disk 110, a tie rod 120, a compressor blade 130, a compressor vane 140, and a compressor casing 150.

The compressor blade 130 is mounted to the compressor disk 110, and the tie rod 120 is positioned through the compressor disk 110. The compressor disk 110 rotates along with the rotation of the tie rod 120 to rotate the compressor blade 130.

The compressor disk 110 may comprise a plurality of compressor disks 110. The plurality of compressor disks 110 are fastened by the tie rod 120 so as not to be axially separated from each other. The individual compressor disks 110 are axially aligned by the tie rod 120 passing therethrough. Each of the compressor disks 110 may have a plurality of protrusions (not shown) formed on the outer peripheral portion thereof, and may have a flange (not shown) coupled to an adjacent compressor disk 110 for rotation together therewith.

A compressor disk cooling passage 112 may be formed in at least one of the plurality of compressor disks 110. The air compressed by the compressor blade 130 in the compressor 10 may move through the compressor disk cooling passage 112 to the turbine 30 to cool the turbine blades.

The tie rod 120 is positioned through the compressor disks 110 and aligns the compressor disks 110. The tie rod 120 receives torque generated in the turbine 30 to rotate the compressor disks 110. To this end, a torque tube 180 may be disposed between the compressor 10 and the turbine 30 and may be a torque transmission member that transmits the rotational torque generated in the turbine 30 to the compressor 10.

One end of the tie rod 120 is fastened to a compressor disk positioned at the most upstream side, and the other end thereof is inserted into the torque tube 180. The other end of the tie rod 120 is fastened to a pressure nut (not shown) in the torque tube 180. The pressure nut pressurizes the torque tube 180 toward the compressor disks 110 so that the individual compressor disks 110 are pressed against each other.

The compressor blade 130 may comprise a plurality of compressor blades 130 radially coupled to the outer peripheral surface of each compressor disk 110. The compressor blades 130 may be formed in a multistage manner by the axially aligned compressor disks 110. Each of the compressor blades 130 may have a compressor blade root member to fasten it to the associated compressor disk 110, and the compressor disk 110 may have a compressor disk slot to insert the compressor blade root member.

The compressor blade 130 rotates along with the rotation of the compressor disk 110 to compress air introduced thereinto while moving compressed air to a rear-stage compressor vane 140. Air is increasingly compressed to a high pressure while passing through the multistage compressor blades 130.

The compressor vane 140 guides compressed air from a front-stage of the compressor blade 130 to a rear-stage of the compressor blade 130. In an embodiment, at least some of the plurality of compressor vanes 140 may be mounted to be rotatable within a fixed range for regulating an inflow rate of air or the like.

The compressor vane 140 is mounted in the compressor casing 150 or a vane carrier 200 to be described later. The compressor vanes 140 may be formed in a multistage manner. The stages formed by the compressor vanes 140 may be arranged alternately with the stages formed by the compressor blades 130 when viewed in the axial direction.

The compressor casing 150 defines the external appearance of the compressor 10. The compressor casing 150 accommodates the compressor disk 110, the tie rod 120, the compressor blade 130, the compressor vane 140, etc. therein.

The compressor casing 150 may have a connection pipe formed to move the air compressed in several steps by the multistage compressor blades 130 to the turbine 30 for cooling the turbine blades.

An intake 160 is positioned at the inlet of the compressor 10. The intake 160 is used to introduce outside air into the compressor 10. A compressor diffuser 170 is disposed at the outlet of the compressor 10 to diffuse and move compressed air. The compressor diffuser 170 rectifies compressed air before the air compressed in the compressor 10 is supplied to the combustor 20, and converts some of the kinetic energy of compressed air into a static pressure. The compressed air having passed through the compressor diffuser 170 is introduced into the combustor 20.

Figure 3:
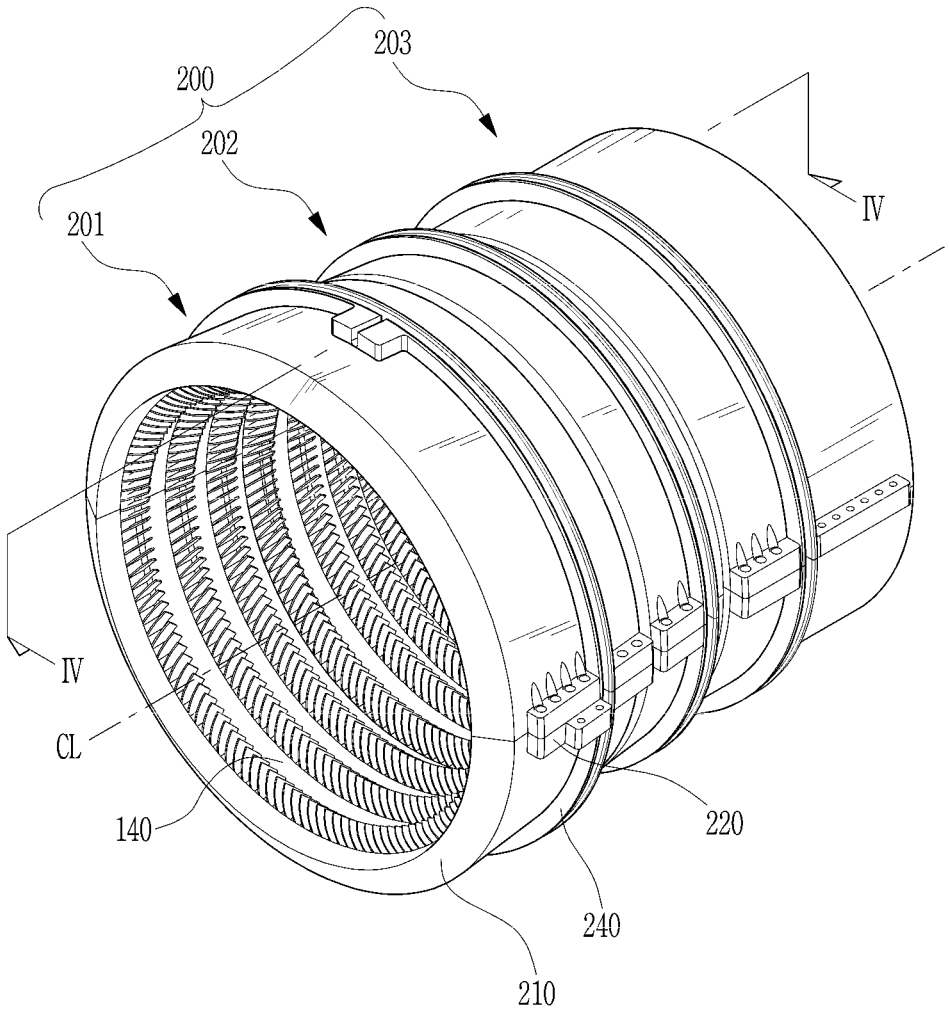
FIG. 3 is a perspective view illustrating a plurality of vane carriers according to the embodiment of the present disclosure.
Figure 4:
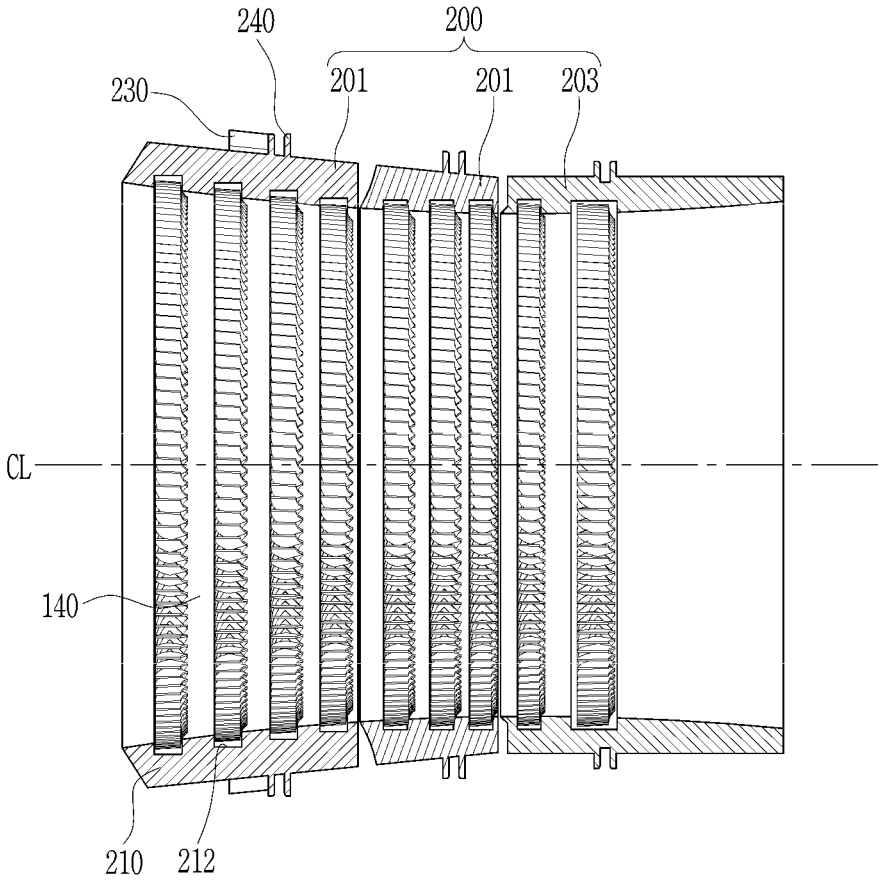
FIG. 4 is a cross-sectional view taken along line IV-IV of FIG. 3.
Figure 5:
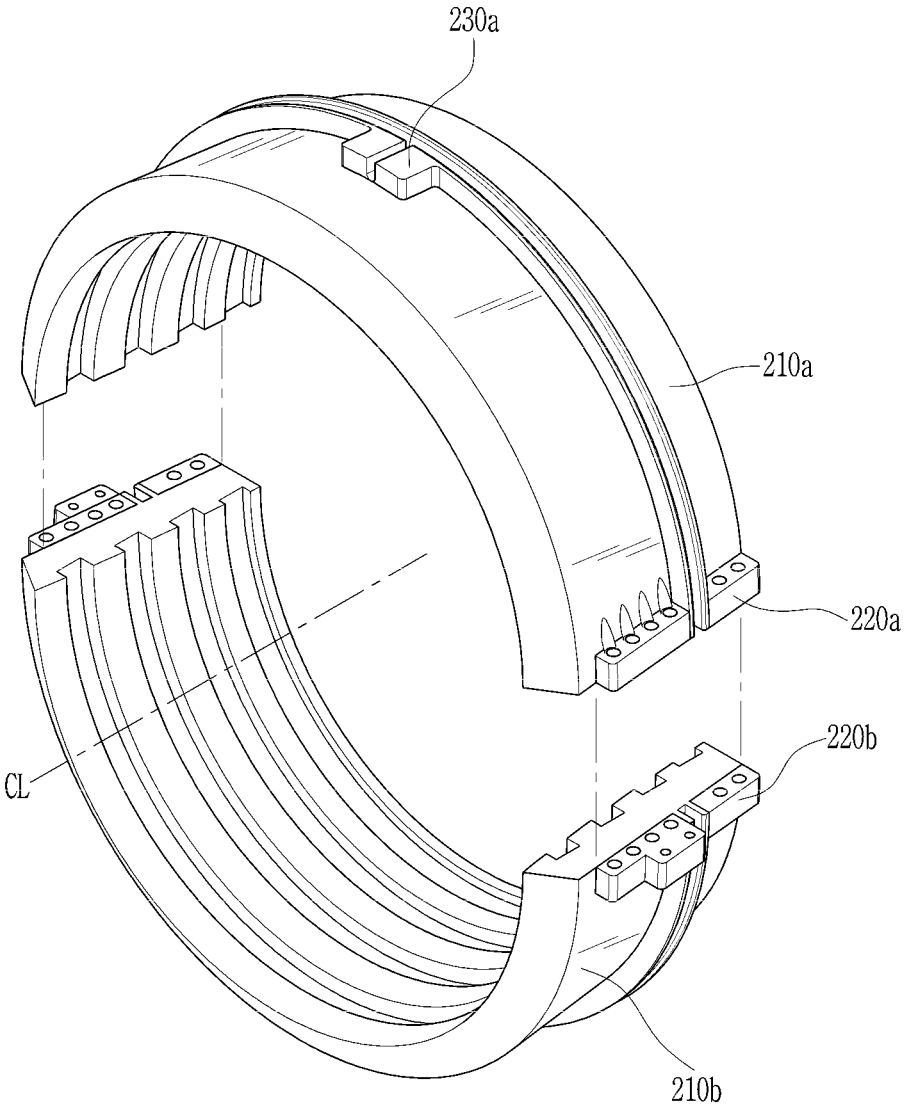
FIG. 5 is a perspective view illustrating one vane carrier according to the embodiment of the present disclosure.

FIG. 3 is a perspective view illustrating a plurality of vane carriers according to the embodiment of the present disclosure. FIG. 4 is a cross-sectional view taken along line Iv-Iv of FIG. 3. FIG. 5 is a perspective view illustrating one vane carrier according to the embodiment of the present disclosure.

The vane carrier 200 supports the compressor vane 140 and is fixed in the compressor casing 150. The vane carrier 200 includes a pair of bodies 210 (210*a* and 210*b*), fastening parts 220 (220*a* and 220*b*), and a deformation prevention member 230 or 230*a*.

The vane carrier 200 is fixed by fastening the outer peripheral surface thereof to the compressor casing 150. The plurality of vane carriers 200 (201, 202, and 203) may each have an annular shape, accommodate the multistage vanes 140, and be axially arranged in response. In the present specification, the axial direction refers to a direction parallel to the central axis CL passing through the center of the annular vane carrier, the radial direction refers to a direction parallel to the radius of the annular vane carrier, and the circumferential direction refers to a direction parallel to the circumference of the annular vane carrier.

Each of the bodies 210*a* and 210*b* has a semi-annular shape so that they are coupled to each other to form an annular shape. The body has at least one annular slot 212 formed along the inner peripheral surface thereof such that the compressor vane 140 is disposed in an annular form on the inner peripheral surface of the body. One annular slot 212 may be formed or a plurality of annular slots 212 may be axially arranged in parallel with each other according to the model or assembly position of the vane carrier 200. Although the vane carrier 200 is illustrated as having the plurality of annular slots 212 in the embodiment, the present disclosure is not limited thereto.

The fastening parts 220 are formed on the outer peripheral surfaces of respective ends at which the semi-annular bodies 210 are coupled to each other and protrude radially from the outer peripheral surfaces of the ends. The fastening parts 220 may be formed integrally with the bodies 210 and made of the same material.

The semi-annular bodies 210*a* and 210*b* are coupled in an annular form by coupling the fastening parts 220*a* and 220*b* disposed on the different bodies 210*a* and 210*b*. The fastening parts 220 may be fastened by fastening members such as bolts, but the present disclosure is not limited thereto. For example, the fastening parts may be fastened by various fastening members capable of securely fixing the two bodies.

The bodies 210*a* and 210*b* are disposed at upper and lower sides in the vane carrier 200. The upper body 210*a* may be fixed to an upper vane casing 150, and the lower body 210*b* may be fixed to a lower vane casing 150. In this case, the fastening parts 220*a* and 220*b* of the respective ends of the bodies may be horizontally disposed in parallel with each other.

Figure 6A:
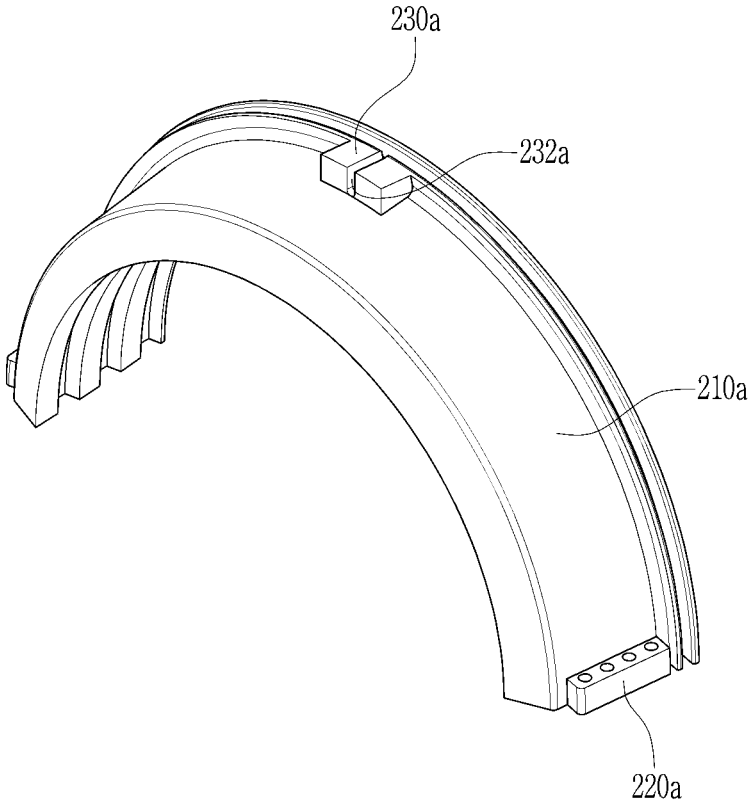
FIGS. 6A to 6C are views illustrating various modifications of the vane carrier according to the embodiment of the present disclosure.
Figure 6B:
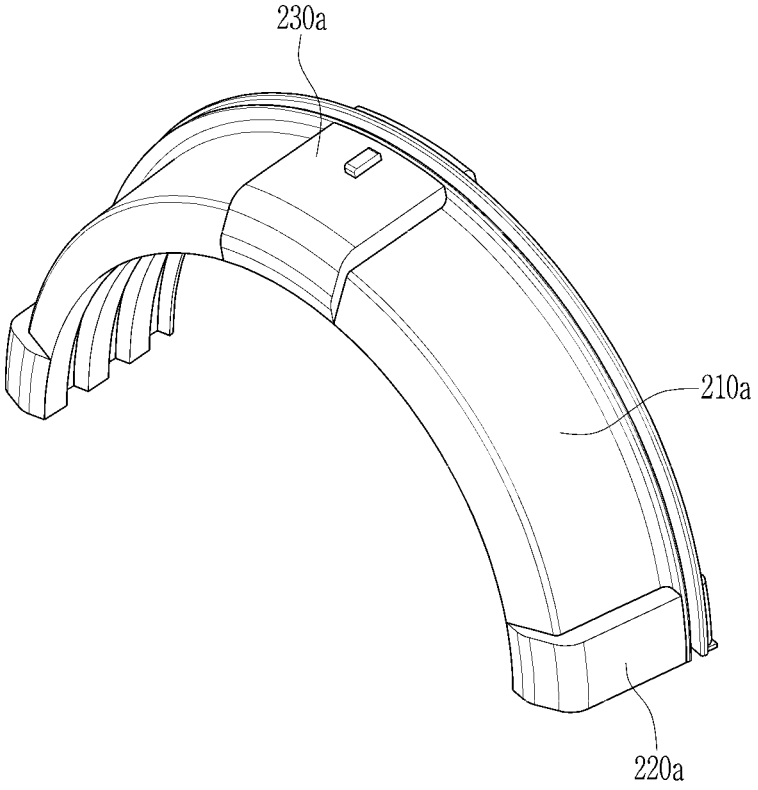
Figure 6C:
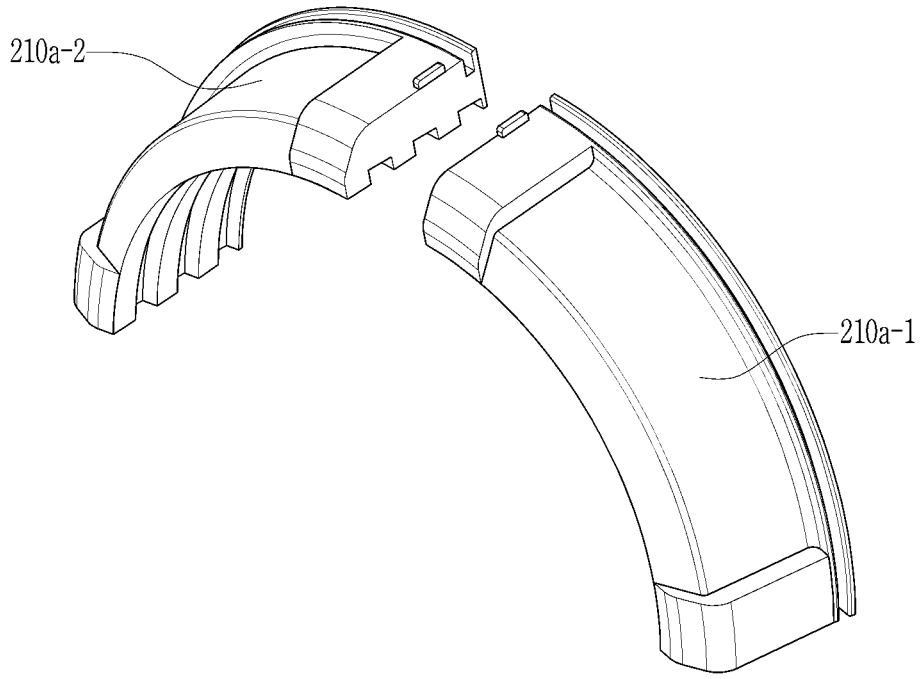

FIGS. 6A to 6C are views illustrating various modifications of the vane carrier according to the embodiment of the present disclosure.

The deformation prevention member 230 is a means for preventing the bodies 210 of the vane carrier from being deformed by heat. At least one deformation prevention member 230 or 230*a* is disposed on the outer peripheral surface of each body 210*a* or 210*b*. The deformation prevention member 230 protrudes radially from the outer peripheral surface of the body.

The deformation prevention members 230 may face each other and be symmetrically disposed with respect to the center of the annular body 210. In the embodiment, the deformation prevention members 230 are disposed at the intermediate portions of the respective bodies to face each other with respect to the center of the annular body. However, the number and positions of the deformation prevention members 230 are not limited thereto. When the bodies 210*a* and 210*b* are disposed at upper and lower sides, the deformation prevention members 230 may vertically face each other.

Hot air passes through the vane carrier 200 while flowing in the compressor 10. In this case, the bodies 210 are thermally expanded by the hot air. Each body 210 is relatively less expanded at the portion where the fastening part 220 is disposed due to the size and mass of the fastening part 220 and is relatively more expanded at the portion without the fastening part, with the consequence that the entire vane carrier 200 is unevenly thermally deformed in an elliptical form.

This uneven thermal deformation can be prevented by disposing the deformation prevention member 230 on the outer peripheral surface of the body 210. The deformation prevention member 230 may be made of the same material and mass as the fastening part 220 in order to balance with the fastening part 220 during thermal expansion.

Meanwhile, the deformation prevention member 230 may be formed integrally with the body 210 in order to minimize the influence by vibration. It is preferable that the deformation prevention member 230 protrudes radially to a lower height than the fastening part 220 in order to avoid interference with the compressor casing 150 when the vane carrier 200 is assembled to the compressor casing 150.

The deformation prevention member 230 is formed with a certain size and mass. However, the size and shape of the deformation prevention member 230 may be adjusted according to the model and structure of the compressor, the temperature condition, the thickness and material of the body 210 and the fastening part 220, or the like.

The deformation prevention member 230 may deform the shape and mass of the vane carrier 200, thereby adjusting the natural frequency of the vane carrier 200 and allowing resonance avoidance.

As illustrated in FIG. 6A, a separation groove 232*a* may be formed along the axial direction CL passing the center of the annular body 210. The separation groove 232*a* may easily align the vane carrier 200 with the compressor casing 150 during assembly.

As illustrated in FIG. 6B, the deformation prevention member 230 may have a shape corresponding to the fastening part 220 or 220*a* and may be made of the same material and mass. When the deformation prevention member 230 is formed as described above, the deformation prevention member 230 and the fastening part 220 are uniformly affected by heat, thereby enabling the body 210 to be thermally deformed with more uniformity.

In addition, the body 210 is again separated in half to have detachable bodies 210*a*-1 and 210*a*-2, each being a quarter arc as illustrated in FIG. 6C. The detachable bodies 210*a*-1 and 210*a*-2 may have fastening parts 210*a* formed at their ends thereof and deformation prevention members 230 may be formed at the other ends of the respective detachable bodies 210*a*-1 and 210*a*-2. In this case, the facing deformation prevention members 230 may also be assembled by a fastening member for fastening them.

The body 210 may have an annular flange 240 circumferentially formed on the outer peripheral surface thereof. The flange 240 is fitted in a groove formed in the inner surface of the compressor casing 150 to fix vane carrier 200. As illustrated in FIGS. 6A and 6B, the deformation prevention member 230 may be disposed in contact with the flange 240. The deformation prevention member 230 may axially extend, in which case it may extend back and forth in the axial direction of the flange.

The combustor 20 mixes the compressed air supplied from the outlet of the compressor 10 with fuel for isobaric combustion to produce high-energy combustion gas. The combustor 20 is disposed downstream of the compressor 10 and includes a plurality of burner modules annularly arranged around the rotary shaft thereof.

The high-temperature and high-pressure combustion gas discharged from the combustor 20 is supplied to the turbine 30. The high-temperature and high-pressure combustion gas supplied to the turbine applies impingement and reaction force to the turbine blades, thereby causing rotational torque. The obtained rotational torque is transmitted to the compressor 10 through the torque tube 180, and the remainder of the power required to drive the compressor is used to drive a generator or the like.

The turbine 30 basically has a structure similar to the compressor 10. That is, the turbine 30 includes a plurality of turbine disks similar to the compressor disks 110 of the compressor 10. Each of the turbine disks also includes a plurality of turbine blades arranged radially therefrom. The turbine blades may be formed in a multistage manner. A turbine vane fixed to the turbine casing is disposed between the turbine blades of the turbine disk to guide the flow direction of the combustion gas having passed through the blades.

Similar to the compressor 10, the turbine vane may be fixed by the vane carrier in the turbine 30. The characteristics of the vane carrier 200 may be applied to the turbine 30 as well as the compressor 10 in the same principle. That is, since technical features such as the shape and structure of the vane carrier 200 used in the turbine 30 are the same as those of the vane carrier used in the compressor, a detailed description thereof will be omitted.

Figure 7A:
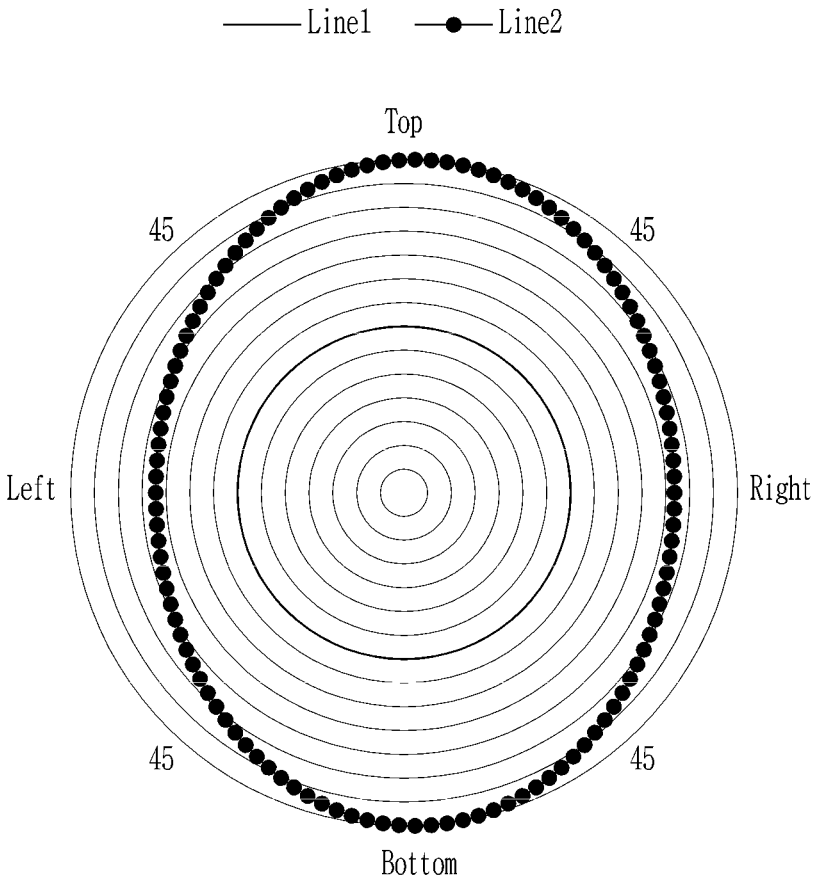
FIGS. 7A and 7B are results of simulating a degree of thermal deformation of the vane carrier according to the related art and the embodiment of the present disclosure.
Figure 7B:
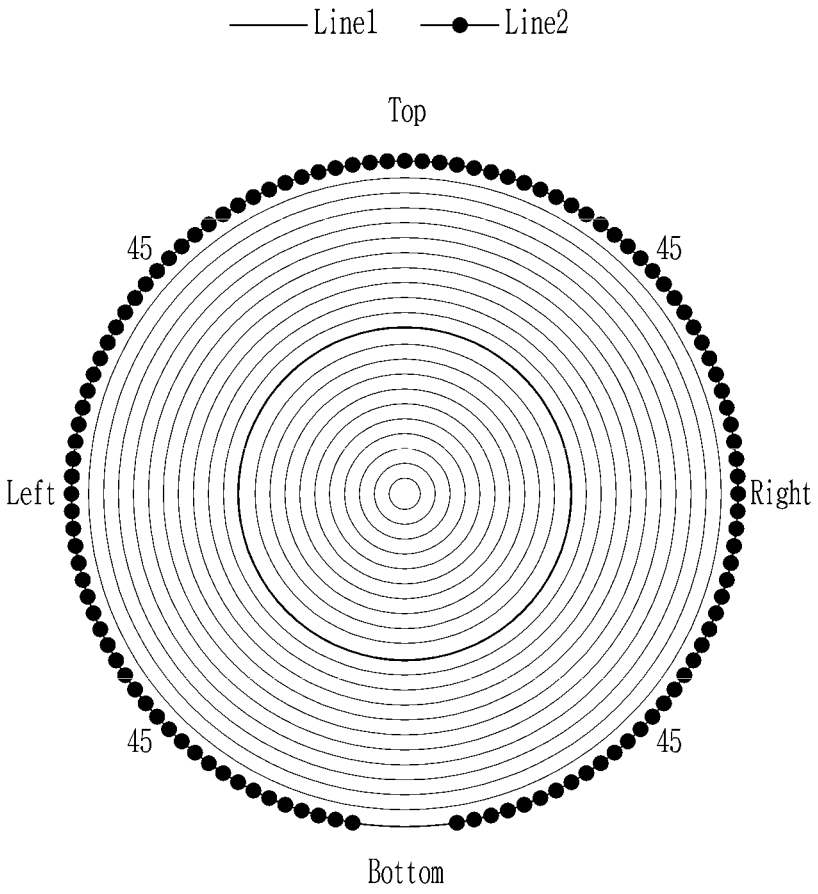

FIGS. 7A and 7B are results of simulating a degree of thermal deformation of the vane carrier according to the related art and the embodiment of the present disclosure.

FIG. 7A is a result of simulating a degree of thermal deformation of the vane carrier during the operation of the gas turbine having the conventional vane carrier with no deformation prevention member. FIG. 7B is a result of simulating a degree of thermal deformation of the vane carrier during the operation of the gas turbine having the vane carrier according to the embodiment of the present disclosure.

Since the amount of deformation caused by heat of the vane carrier is very small compared to the size of the actual vane carrier, a graph is generated by extracting only the amount of deformation from each node point of the vane carrier analysis model. Line 1 is a line indicating the cross section of the vane carrier when assuming that the amount of deformation is "0", and Line 2 is a line indicating the amount of deformation when dividing the radius of Line 1 by a certain number (Normalization).

As illustrated in FIG. 7A, it can be seen that the conventional vane carrier is thermally deformed in the vertical direction due to the left and right fastening parts 220 and its circular cross section is deformed into an elliptical shape extending in the vertical direction.

On the other hand, in the vane carrier according to the embodiment of the present disclosure, the vertical deformation prevention member 230 suppresses thermal deformation in the vertical direction so that the circular cross section of the vane carrier uniformly thermally expands in all directions with respect to the center thereof. Therefore, it is possible to substantially maintain the circular cross section of the vane carrier after thermal deformation.

As is apparent from the above description, in accordance with the exemplary embodiments of the present disclosure, it is possible to prevent damage to components due to deformation since the vane carrier is relatively uniformly thermally deformed.

In accordance with the exemplary embodiments of the present disclosure, it is possible to improve durability by adjusting the natural frequency of the vane carrier to avoid resonance.

The accompanying drawings, in these embodiments, and the present specification, merely that shows clearly some of the technical idea is also included in the present disclosure, to those skilled in the art to easily infer that within the scope of the technical ideas including the specification and drawings of the present disclosure various modifications and specific embodiments that will be apparent to all that is included in the scope of the present disclosure.

What is claimed is:

1. A vane carrier for supporting a vane provided in a gas turbine, comprising:

a pair of bodies to have a plurality of vanes arranged on their inner peripheral surfaces, and the pair of bodies to form an annular shape by coupling the bodies in a semi-annular form to each other;

fastening parts to protrude radially from outer peripheral surfaces of respective ends of the bodies coupled to each other so as to couple the bodies; and at least one deformation prevention member disposed on the outer peripheral surfaces of the bodies and to protrude radially therefrom, wherein the at least one deformation prevention member protrudes radially to a lower height than the fastening parts and extends axially to a length shorter than the fastening parts.

2. The vane carrier according to claim 1, wherein the at least one deformation prevention member faces each other and is symmetrically disposed with respect to a center of the pair of bodies in the annular shape.

3. The vane carrier according to claim 2, wherein:

the bodies are veltically disposed so that the fastening parts are horizontally arranged in parallel with each other; and the at least one deformation prevention member vertically faces each other.

4. The vane carrier according to claim 1, wherein the at least one deformation prevention member is of a shape corresponding to the fastening parts.

5. The vane carrier according to claim 1, wherein the at least one deformation prevention member is made of a same material and mass as the fastening parts.

6. The vane carrier according to claim 1, wherein each of the at least one deformation prevention member has a separation groove formed in an axial direction passing a center of the pair of bodies in the annular shape.

7. The vane carrier according to claim 1, wherein each of the at least one deformation prevention member is formed integrally with the bodies and the fastening parts.

8. A compressor comprising:

compressor disks arranged in a multistage manner, each of the compressor disks to have a plurality of compressor blades mounted thereto;

a tie rod axially to pass through the compressor disks and to rotate the compressor disks by rotation thereof, a vane carrier to support multistage compressor vanes arranged alternately with the plurality of compressor blades; and a casing accommodating the compressor disks, the tie rod, and the vane carriers therein, wherein the vane carrier comprises:

a pair of bodies to have the plurality of vanes arranged on their inner peripheral surfaces, and the pair of bodies to form an annular shape by coupling the bodies in a semi-annular form to each other;

fastening parts to protrude radially from outer peripheral surfaces of respective ends of the bodies coupled to each other so as to couple the bodies; and at least one deformation prevention member disposed on the outer peripheral surfaces of the bodies and to protrude radially therefrom, wherein the at least one deformation prevention member protrudes radially to a lower height than the fastening parts and extends axially to a length shorter than the fastening parts.

9. The compressor according to claim 8, wherein the at least one deformation prevention member faces each other and is symmetrically disposed with respect to a center of the pair of bodies in the annular shape.

10. The compressor according to claim 9, wherein:

the bodies are vertically disposed so that the fastening parts are horizontally arranged in parallel with each other; and the at least one deformation prevention member vertically faces each other.

11. The compressor according to claim 8, wherein the at least one deformation prevention member is of a shape corresponding to the fastening parts.

12. The compressor according to claim 8, wherein each of the at least one deformation prevention member has a separation groove formed in an axial direction passing a center of the pair of bodies in the annular shape.

13. The compressor according to claim 8, wherein the at least one deformation prevention member is made of a same material and mass as the fastening parts.

14. The compressor according to claim 8, wherein the at least one deformation prevention member is formed integrally with the bodies and the fastening parts.

15. A gas turbine comprising:

a compressor to compress air introduced thereinto;

a combustor to mix the air compressed in the compressor with fuel for combustion; and a turbine to generate power by gas combusted in the combustor, wherein the compressor comprises:

compressor disks arranged in a multistage manner, each of the compressor disks to have a plurality of compressor blades mounted thereto;

a tie rod to axially pass through the compressor disks and to rotate the compressor disks by rotation thereof, a vane earlier to support multistage compressor vanes arranged alternately with the plurality of compressor blades; and a casing accommodating the compressor disks, the tie rod, and the vane carriers therein, wherein the vane carrier comprises:

a pair of bodies to have the plurality of vanes arranged on their inner peripheral surfaces, and the pair of bodies to form an annular shape by coupling the bodies in a semi-annular form to each other;

fastening parts to protrude radially from outer peripheral surfaces of respective ends of the bodies coupled to each other so as to couple the bodies; and at least one deformation prevention member disposed on the outer peripheral surfaces of the bodies and to protrude radially therefrom, wherein the at least one deformation prevention member protrudes radially to a lower height than the fastening parts and extends axially to a length shorter than the fastening parts.

16. The gas turbine according to claim 15, wherein the at least one deformation prevention member faces each other and is symmetrically disposed with respect to a center of the bodies in the annular shape.

17. The gas turbine according to claim 16, wherein:

the bodies are vertically disposed so that the fastening parts are horizontally arranged in parallel with each other; and the at least one deformation prevention member vertically faces each other.

18. The gas turbine according to claim 15, wherein the at least one deformation prevention member is of a shape corresponding to the fastening parts.

* * * * *